United States Patent [19]

Cupido

[11] 4,316,419

[45] Feb. 23, 1982

[54] PLASTICS PALLET

[75] Inventor: Ernst P. Cupido, Hardenberg, Netherlands

[73] Assignee: Wavin, B.V., Handellaan, Netherlands

[21] Appl. No.: 971,223

[22] Filed: Dec. 20, 1978

Related U.S. Application Data

[63] Continuation-in-part of Ser. No. 748,306, Dec. 7, 1976, abandoned.

[30] Foreign Application Priority Data

Dec. 9, 1975 [NL] Netherlands ..... 7514365
Dec. 9, 1975 [NL] Netherlands ..... 7514366

[51] Int. Cl.[3] ..... B65D 19/32
[52] U.S. Cl. ..... 108/56.1; 108/57.1; 108/901; 108/902
[58] Field of Search ..... 108/51.1–57.1; 206/386, 596–600

[56] References Cited

U.S. PATENT DOCUMENTS

| | | | |
|---|---|---|---|
| 2,783,960 | 3/1957 | Herz et al. | 108/56.1 |
| 3,307,504 | 3/1967 | Lloyd et al. | 108/56.1 |
| 3,719,157 | 3/1973 | Arcocha et al. | 108/51.1 |
| 3,720,176 | 3/1973 | Munroe | 108/51.1 |
| 3,824,933 | 7/1974 | Lind | 108/56.1 |
| 3,857,342 | 12/1974 | Johns | 108/56.1 X |
| 3,880,092 | 4/1975 | Seeber et al. | 108/51.1 |
| 3,910,204 | 10/1975 | Jesse | 108/51.1 X |
| 3,964,400 | 6/1976 | Brand | 108/51.1 |

FOREIGN PATENT DOCUMENTS

| | | | |
|---|---|---|---|
| 2101535 | 9/1972 | Fed. Rep. of Germany | 108/51.1 |

*Primary Examiner*—William E. Lyddane
*Attorney, Agent, or Firm*—Ostrolenk, Faber, Gerb & Soffen

[57] ABSTRACT

A plastic pallet provided with oblong channels in which reinforcing rods are locked. The locking is obtained by partially closing the end of a channel or by inwardly shrunk edge parts of openings in said channels.

6 Claims, 17 Drawing Figures

PLASTICS PALLET

This application is a continuation-in-part application of my prior application Ser. No. 748,306 filed Dec. 7, 1976 and now abandoned.

BACKGROUND OF THE INVENTION

The invention relates to a plastic pallet comprising at least one upper surface, whether provided with openings passing through and through or not, and blocks fixedly secured to the upper surface and extending on the underside of the upper surface.

Pallets of this type comprising an under surface and an upper surface interconnected by partitions as well as blocks, secured on or in the proximity of angular points for supporting pallets, are known in the art.

These known pallets present the disadvantage that much plastic material is required for their manufacture, as they should have a rigidity which suffices to absorb the forces exerted on the pallet, when a load is applied thereto.

In order to save plastic material, openings in the upper surface have been proposed so that the pallets can also be more easily cleaned, but it is obvious that this is attended with a loss of strength properties.

SUMMARY OF THE INVENTION

The invention now aims to provide a pallet for which the smallest possible quantities of material are used and which nevertheless can take very high loads.

Another aim of the invention is to provide a pallet which, after a period of use of the pallets, when they are for instance seriously damaged, can be returned as a whole to a location for recovering the plastic as scrap suitable for the production of new articles.

Thus, the invention provides a pallet of plastic material, comprising:

an upper loading surface, the upper loading surface having an underside, the upper loading surface being defined about its periphery by side edges;

a plurality of blocks secured to the pallet and extending on the underside of and projecting down from the upper loading surface;

located underneath the upper loading surface and spaced inwardly from the side edges thereof, there is at least one oblong shaped reinforcing channel;

walls which are attached underneath the upper loading surface for defining the channel; the channel having an upper side that is at least partly defined by the upper loading surface, the channel being shaped and adapted for removably receiving a reinforcing member;

a reinforcing member in said channel, and means for locking the reinforcing member in said channel in a removable way.

Even when many openings pass through the upper loading surface of the pallet, so that large quantities of plastic material for the plastic pallet are saved, the desired strength is obtained due to the presence of such reinforcing channels and rigid reinforcing members accomodated in the reinforcing channels, so that loading the pallet can be increased to a maximum.

The reinforcing members consist advantageously of massive or hollow profiles, preferably at metal ribs or rods which are slid into the reinforcing channels, in order to impart the desired strength.

When after a period of use of the pallets, they are for instance seriously damaged, they can be returned as a whole to the location where plastic waste is processed, due to the provision of these reinforcing members in the reinforcing channels. After removal of the rigid reinforcing members, the pallets can be turned into scrap.

This is a considerable advantage since on the one hand a considerable strength can thus be imparted to the pallets, while on the other hand no difficulties owing to the reinforcing members are experienced in case of a future processing.

By using for instance a reinforcing rod which at its end zone is provided with a hook, the rods may be easily removed from the reinforcing channels at the time that the pallet is destroyed. This would be impossible when the reinforcing members would be embedded in the plastic pallets, since in that case special operations would be required to separate the metal reinforcing rods from the pallets.

The reinforcing channels extends conveniently parallel to two sides of a pallet which are at right angles with each other, and preferably extend through the centre of for example two blocks.

Thus a reinforcement is produced by reinforcing channels which are perpendicular to each other, which allows an optimal loading of the pallet. The greater part of the load to which the pallet is subjected is now transferred to the blocks which are constructed such that they offer a considerable resistance to bulging of the walls so that very high loads can be taken up.

It is necessary to lock the reinforcing members in the reinforcing channels in a removable way for which purpose the reinforcing channels have wall recesses which are alternately provided in opposite wall parts of a reinforcing channel. This allows the use of a simple mould for production.

The reinforcing channels thus take a slightly undulatory configuration in the longitudinal direction when a pallet according to the invention is formed by injection moulding. Reinforcing members as introduced into the channels are automatically fixed without the use of individual fixing members or clamping members, on the other hand the reinforcing members can be easily removed from the reinforcing channels.

It has been found that it is advisable to form the pallet according to the invention from a plurality of reinforcing partitions thereby forming the upper loading surface of the pallet and the underside of the pallet, one of the reinforcing partitions being part of the afore-mentioned reinforcing channels.

The reinforcing partitions may have all the same height as the reinforcing channels, but advantageously partly a smaller height which gradually increases to the height of the reinforcing channels in the region of the reinforcing channels, so that bumping of the forks of the fork-lift truck against the channel walls is avoided, the mutual spacing of the reinforcing channels being smaller than the width of a fork of a fork lift truck.

Another wall of the reinforcing channel may comprise a reinforcing block partition, extending below the underside of the pallet which avoids bulging of the black wall.

In this manner the desired reinforcing channels are formed by parts of the pallet which are already indispensable. Radial reinforcing block partitions are namely arranged in the blocks, which block partitions extend towards the periphery from the centre of the block, since the blocks are formed by a circular wall surface. The reinforcing channels are advantageously rectangular in cross section.

The block of the pallet have preferably a rounded shape, in order to facilitate the forks of the fork lift truck to penetrate inbetween two blocks under the pallet.

So as to reinforce the blocks they have radially extending reinforcing walls which can extend as far as the underside of the bearing faces of the blocks.

They extend effectively on the same level as the reinforcing partitions, which are connected with the upper sheet.

Reinforcing members of various types can be used in the reinforcing channels; they may have a circular, rectangular or other shaped section, an I or Z profile, the latter being preferred.

Pallets according to the invention are advantageously manufactured by means of injection moulding of both massive or laminated foam plastic, they may also be of fibre reinforced foam plastic.

Suitable materials to be used are expanded foam plastic of e.g. polyolefines, particularly of high density and medium density polyethylene and of polypropylene.

The loading surface of the pallet may be roughened in order to prevent articles on such a pallet from sliding.

SURVEY OF THE DRAWINGS

THE PREFERRED EMBODIMENTS

Figure 1:
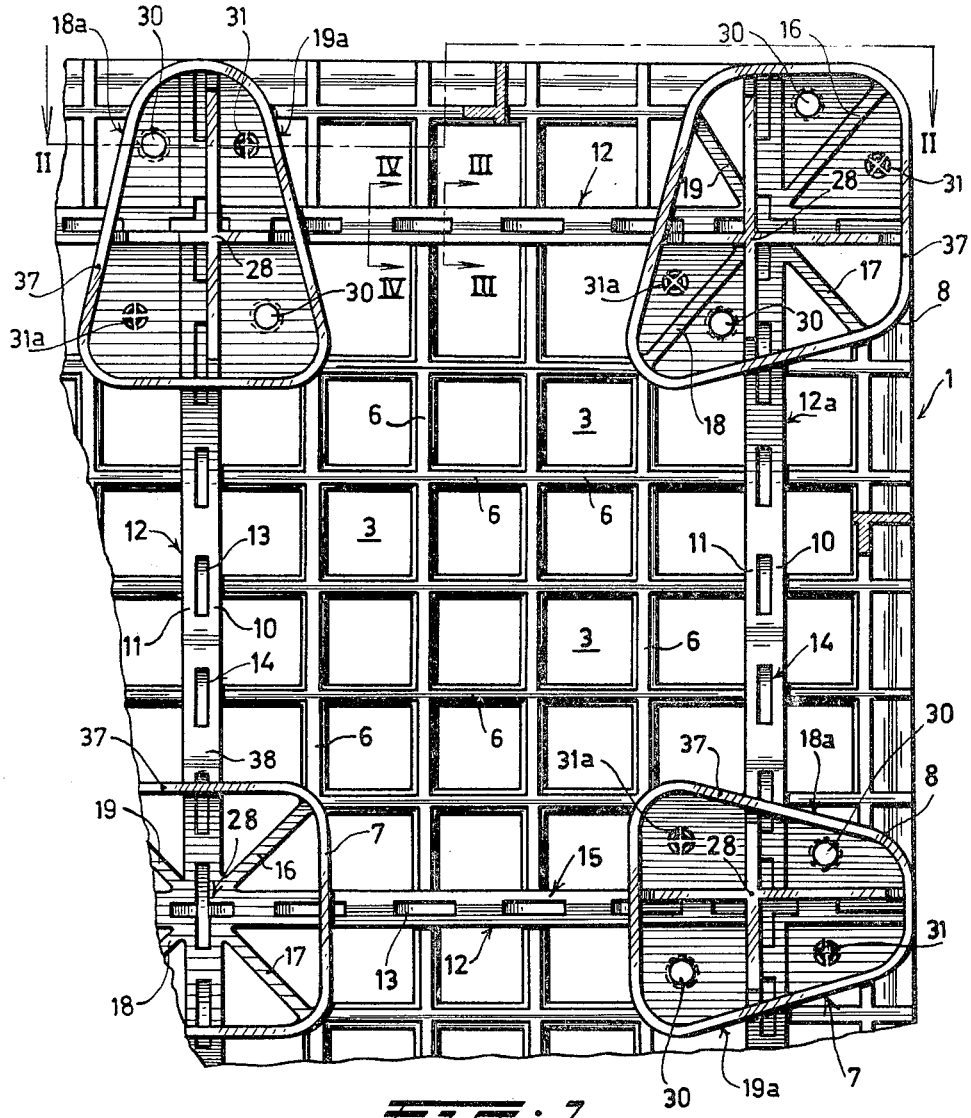
FIG. 1 is a view of the underside of a part of a pallet according to the invention.

FIG. 1 represents a bottom view of a pallet 1 comprising an upper loading surface 2 of plastic material formed by the interconnected partitions 6 which form a grid-shaped structure. Due to the provision of the openings 3 formed by the partitions 6, the pallets according to the invention can be easily cleaned, while moreover large quantities of plastic material can thus be saved. The lower side of the partitions form the underside 5 of the pallet which is in reality an imaginary surface.

Blocks 7 support the pallet. They are at any rate arranged at the angular points and mostly also along the sides between two angular points. These blocks 7 support the grid-shaped structure bound by the loading surface 2 and the underside 5, which are interconnected by reinforcing partitions 6 so that the pallets can be conveyed by means of fork lift trucks.

In order to facilitate the introduction of the forks of a fork lift truck underneath the underside 5 of the pallet, the blocks are rounded at point 8.

In order to prevent the forks of the fork lift truck from entering between the upper loading surface 2 and the underside 5 of the pallet, the spacing between the reinforcing partitions 6 is selected such, that it is smaller than the width of the forks of the fork lift truck, so that the forks can never penetrate inbetween the surface 2 and underside 5, which could give rise to serious damage of the pallets.

The blocks 7 have block reinforcing partitions 16, 17, 18 and 19 extending on the same level as the reinforcing partitions 6. It is however, obvious that the reinforcing partitions 16, 17, 18 and 19 can also extend as far as the free bottomside 9 of the blocks.

The blocks 7 consist of a circular wall face, the underside of which is widened, if desired, so that support faces on the bottomside 9 are formed.

Below the upper loading surface 2 of the pallet there are oblong cross section reinforcing channels 12 defined on one side by a reinforcing partition 6, on the other side by a channel wall surface 10 and enclosed by a channel bottom wall 11. The channel wall surface 10 extends from the upper loading surface 2 as far as the free bottom side of the block 7.

The reinforcing block partitions 10 thus not only serve to reinforce the block, but serve also as wall for the oblong channel 12.

A metal reinforcing rod 13 is locked in the reinforcing channel 12, so that the pallet and particularly the upper loading surface can be optimally loaded. The channel bottom wall 11 and the channel upper wall **12*a* of channels 12 with rectangular cross sections, have recesses 14 and 15 which are alternately situated in the bottom wall of the channel and in the opposite upper wall 12*a* of the channel 12**.

Figure 15:
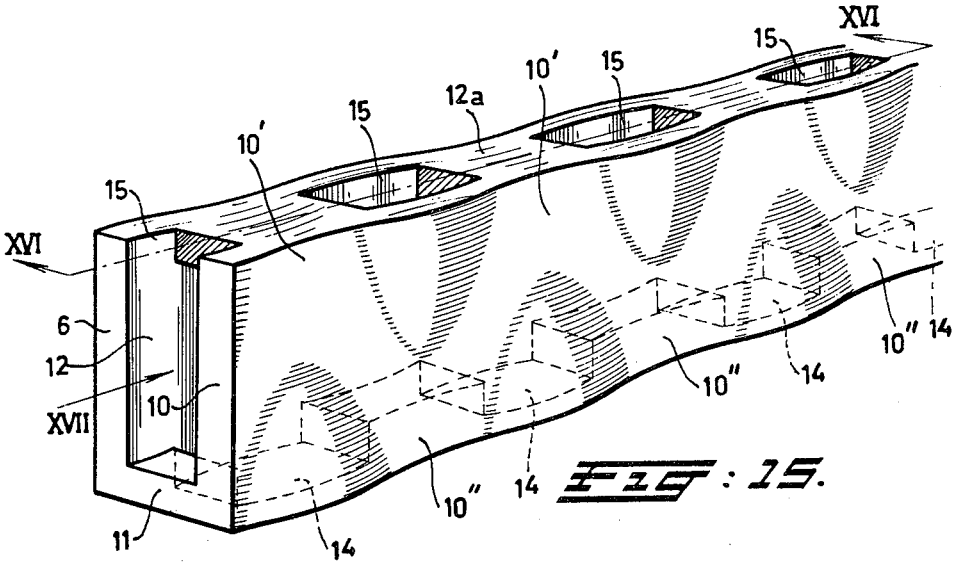
FIG. 15 shows a perspective view of a distorted oblong channel without a reinforcing element after injection moulding and cooling.

When an injection moulding process for the pallet according to the invention is carried out, and a mould is used in which such recesses 14 and 15 are formed, a varying shrinkage of the parts is produced which distort the channel walls 6 and 10 in a particular way as shown in FIG. 15.

After injection moulding there will be metal mould parts 3 and the channels 12 are enclosed by the upper mould part 39 and the lower mould part 3

Now during cooling the heat of the bottom wall 11 of a channel will be removed less rapidly than the heat to be removed from the walls 6 and 10.

As the metal mould parts are removed before complete cooling the walls 6 and 11 will be distorted, the lower part different from the upper part.

Figure 16:
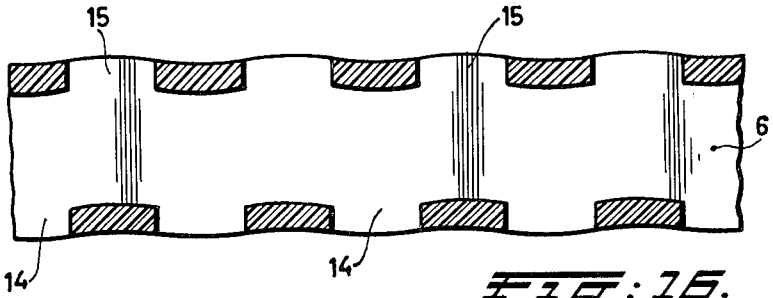
FIG. 16 shows a cross section of such a channel according to line XVI—XVI.
Figure 17:
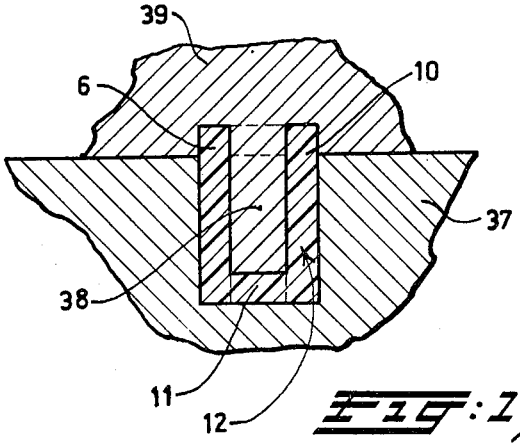
FIG. 17 shows a view of a channel according to FIG. 15 as indicated.

The distortion of the channel walls is also shown schematically in FIG. 16, from which appears that the upper parts 10' of wall 10 have shrunk inwardly and the lower parts 10'' of wall 10 are distorted in a complementary way. The wall parts between two subsequent apertures 15 are distorted inwardly and as the upper and lower apertures 14 and 15 are in a staggered position with respect to each other the wall presents an undulatory configuration in longitudinal direction owing to which a reinforcing member 13 is clampingly received in a channel 12. This presents the considerable advantage that the reinforcing members can be locked in the channels without the use of individual fixing means.

It will be obvious that after having inserted the reinforcing rod 13 the wall distortions existing before the introduction of the rod 13 are removed. The rod 13 pushes the walls in a position adapted to the rod.

In order to obtain a proper strength the reinforcing channels in the pallet extend through the centre of a block so that at least two channels 12 and 13 are positioned at right angles with each other and intersect each other in the centre 28 of the blocks 7.

In order to obtain the desired strength the reinforcing members are mostly recessed, so that the reinforcing members can pass each other in the points of intersection so as to produce a proper reinforcement.

In order to prevent the reinforcing members 13 from leaving the channels the front opening 20 of a longitudinally extending reinforcing channel 12 with side walls may also be constructed in such a way that the reinforcing member 13 can hardly directly leave the channel. To that end the opening 20 is slightly staggered with respect to the longitudinally extending reinforcing channel 12. Since plastic material is used, it is possible to deform slightly the walls 20*a* and 20*b* of the opening, for instance by means of a metal bar, so that the reinforcing rod 13 can be easily introduced, but cannot directly emerge from the channel after insertion. Obviously this becomes possible when the rod 13 is subjected to any pulling action.

So as to produce the desired pallets, two of them are usually coupled such that the blocks are facing each other. This coupling may be accomplished by heat sealing the free ends of blocks together.

In order to promote this coupling operation the lower part of the inside of wall 7*a* of a block may also have some bridges 21 distributed along the inner circumference which, together with wall 7*a* of the block, constitute recesses 22. The bridges 21 have an upper edge 29 bent over in the direction of the wall 7*a* of the block.

At the lower end of the inner wall of a block 7*b* of a second pallet, coupling hooks 23 are arranged, which snappingly engage behind the bent over edges 29 for connecting the two pallets.

When the under faces 24 and 25 of the block walls 7*a* and 7*b* would bear on each other then the coupling hooks 23 with the bridges 21 would be subjected to considerable bending stresses, when a load is applied to the upper pallet. In order to alleviate this difficulty, wall 7*a* has locally deepened centring recesses 26 in which an adapted side 27 of the wall 7*b* of a block can always be received.

When a load is applied an upright part 29 of wall 7*a* of the block prevents side 27 from moving, so that coupling hook 23 stays positioned as well.

According to an advantageous embodiment the space between the reinforcing elements and the walls of the reinforcing channels may be filled, preferably with polyurethane foam. If the upper side of a reinforcing channel is provided with apertures, foam may close these openings or even extend outside these openings for roughening the upper side of the pallet. Polyurethane foam is recommended as it also prevents corrosion of the respective points.

For practical reasons it may be recommended to connect two pallets by heatsealing blocks of two different pallets to each other. This coupling may also be accomplished by means of a glue or by means of a snap connection.

Figure 13:
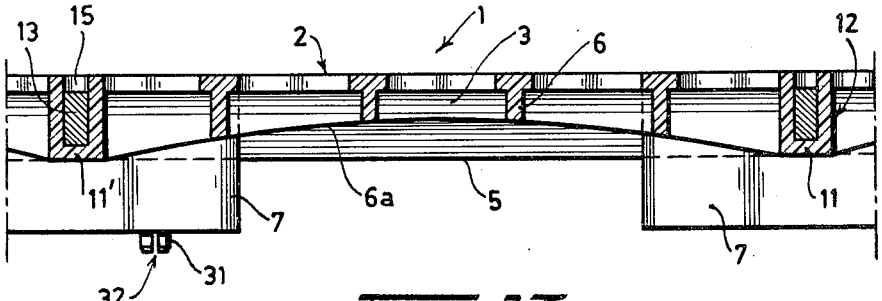
FIG. 13 is a cross section through a pallet according to another embodiment.

FIG. 13 shows a part of a pallet with an upper surface 2 and lower surface 5. The reinforcing partitions 6 between two channels decrease in height from each channel towards the middle region between the two channels and form a cylindrical part recess.

This allows a substantial saving of plastic and the formations of faults 6*a* through the lower ends of the reinforcing partitions, which can act as certain centring means for the fork of a fork lift truck.

Figure 14:
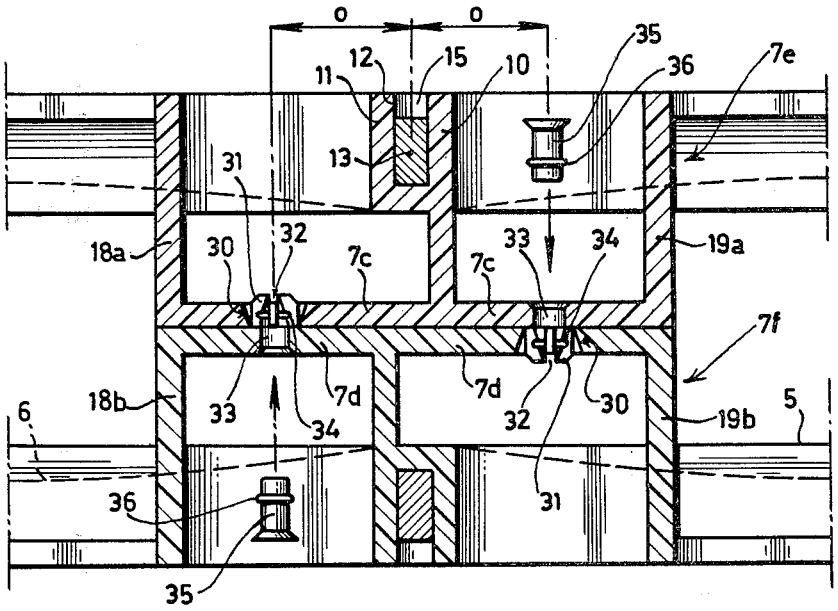
FIG. 14 shows a part of another connection between pallets.

FIG. 14 shows the coupling of two pallets according to FIG. 1 each provided with blocks. The blocks 7*e* and 7*f* are connected with each other.

For the connection block 7*e* is provided with a bottom plane 7*c* whilst block 7*f* is provided with a bottom-plane 7*d*.

Each plane 7*c* and 7*d* is provided with conical openings 30 and connection nipples 31 which are integral with a bottom plane. The connection nipples have also a conical end of substantially the same dimensions as the openings 30. Each nipple 31 has slots 32 which are axially disposed and form a cross. The nipple 31 is hollow and extends into a cylindrical opening 33 in the bottom plane 7*d*. The nipple 31 is a frustrum of a cone on its outer side.

The inner side of the nipple 31 is provided with an annular recess 34.

On the other hand the connection comprises a cylindrical pen 35 with an annular bead 36 which snaps into annular recess 36 and thus presses the nipple 31 against the wall of opening 30.

The block 7*e* comprises partition walls 18*a* and 19*a*, whilst block 7 comprises partition walls 18*b* and 19*b*.

Figure 2:
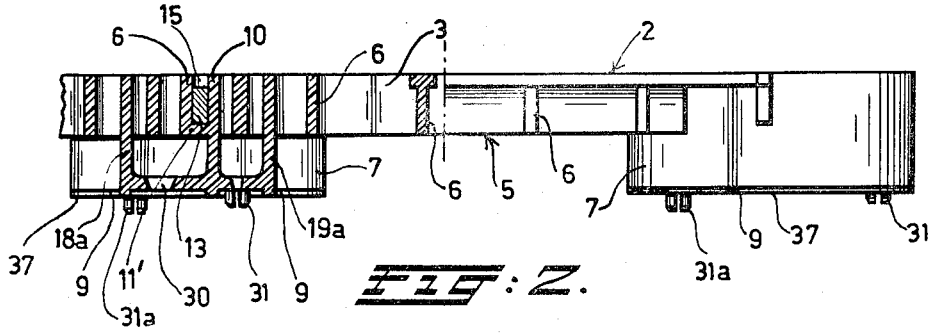
FIG. 2 is a section through such a pallet according to line II—II.
Figure 3:
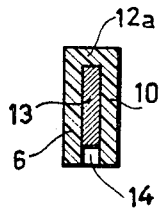
FIG. 3 is a cross section according to line III—III.
Figure 4:
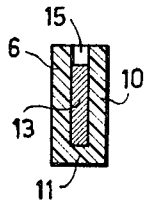
FIG. 4 is a cross section according to line IV—IV.
Figure 5:
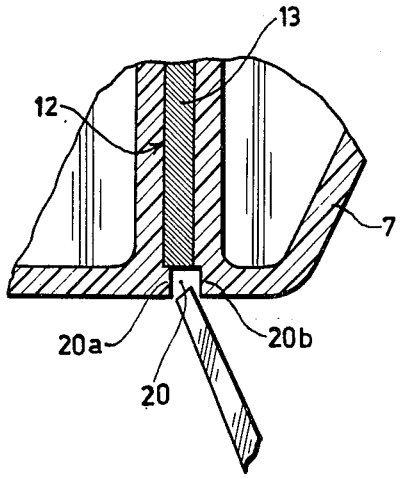
FIG. 5 is a detail of a plastic pallet with an opening on the front, of a longitudinal reinforcing channel with a reinforcing member.
Figure 6:
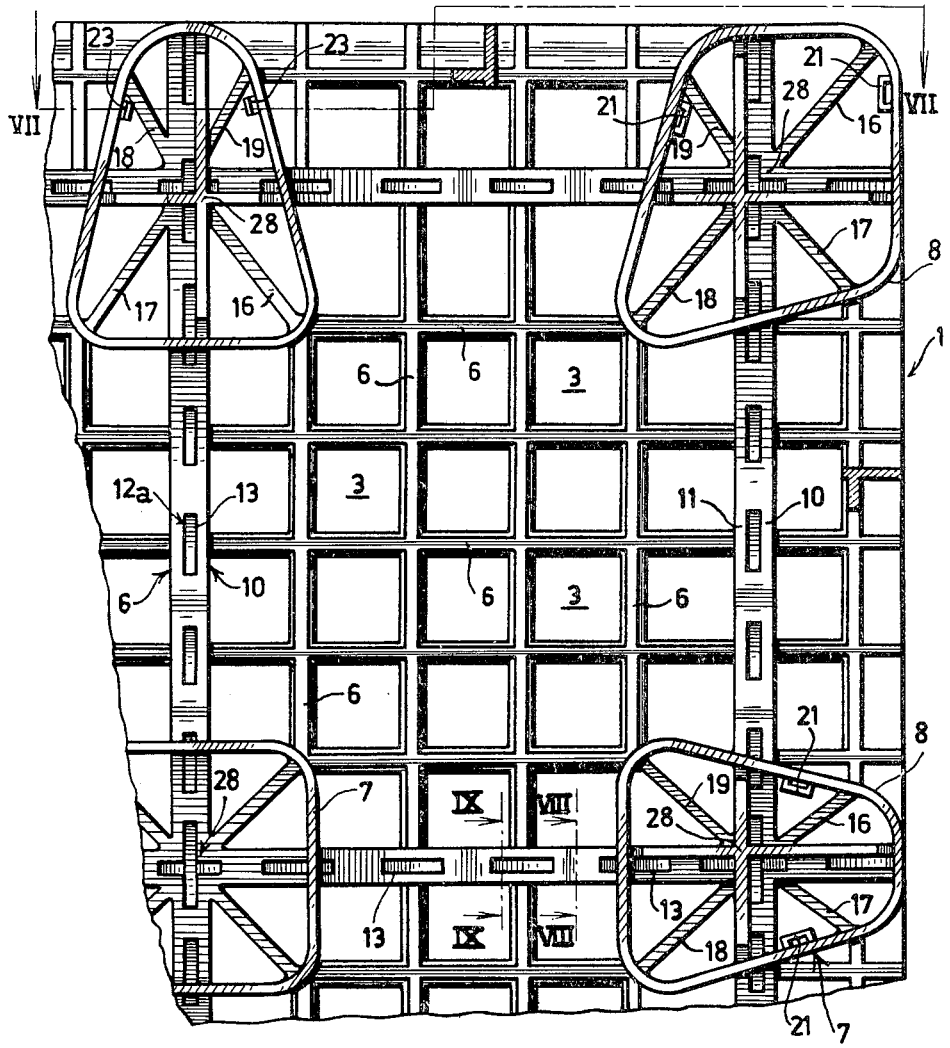
FIG. 6 is a fragmentary view of the underside of another pallet embodiment according to the invention.
Figure 7:
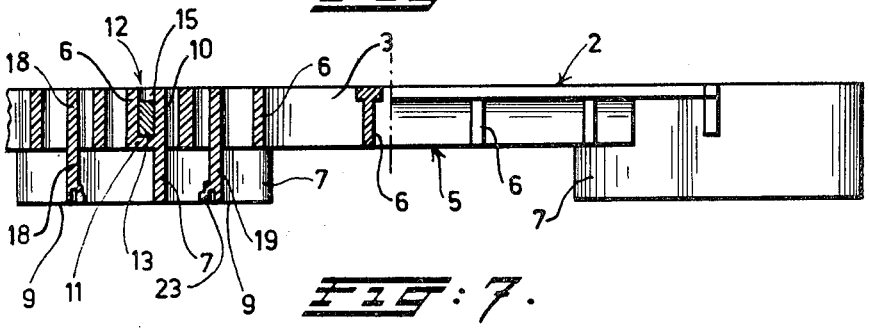
FIG. 7 is a section through such a pallet according to line VII—VII in FIG. 6.
Figure 8:
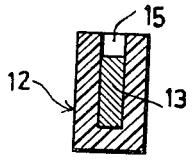
FIG. 8 is a cross section according to line VIII—VIII in FIG. 6.
Figure 9:
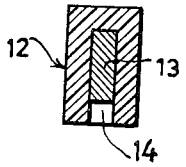
FIG. 9 is a cross section according to line IX—IX in FIG. 6.
Figure 10:
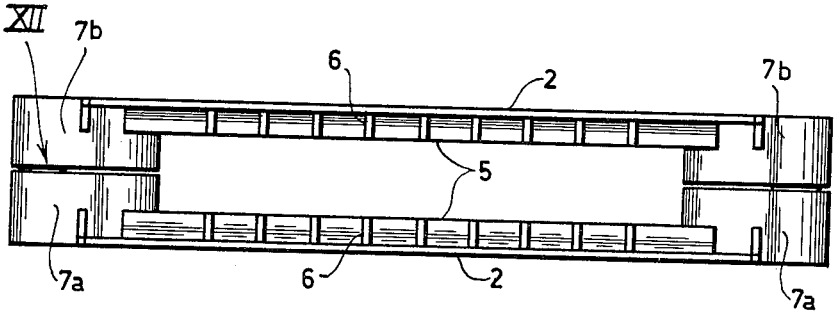
FIG. 10 is a view of two interconnected plastic pallets according to FIG. 6.
Figure 12:
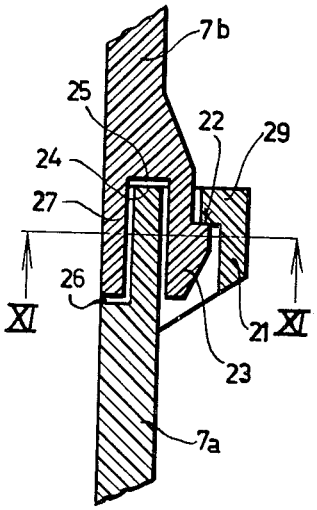
FIG. 12 is a section according to the line XII—XII in FIG. 11.
Figure 11:
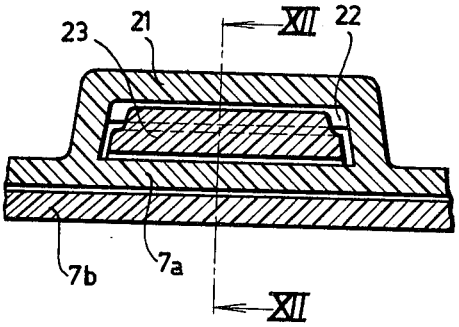
FIG. 11 shows a detail of a cross section through a connection between to pallets.

In order to facilitate the assembly of two pallets it is recommended to use nipples of different height, e.g. nipple 31*a* is long and nipple 31 is short as shown in FIG. 2.

The aperture 30 and a nipple 31 in one bottom plane are symmetrically to the wall 10.

What is claimed is:

1. A pallet of plastic material, comprising an upper loading surface being defined about its periphery by side edges;

a plurality of blocks secured to the pallet and extending on the underside of and projecting down from the upper loading surface;

located underneath the upper loading surface and spaced inwardly from the side edges thereof, there is at least one oblong shaped reinforcing channel;

walls which are attached underneath the upper loading surface for defining the channel; the channel having an upper side that is at least partly defined by the upper loading surface, the channel being shaped and adapted for removably receiving a reinforcing member;

a reinforcing member in said channel; means for locking the reinforcing member in said channel in a removable way, the locking means comprising one of the walls that defines the channel being recessed, whereby the reinforcing channel for accommodating the reinforcing member takes an undulatory configuration in its longitudinal direction, so that the wall clampingly engages the reinforcing member.

2. The pallet of claim 1, wherein the wall that is recessed is recessed at spaced apart locations along the channel for defining the undulatory configuration.

3. A pallet of plastic material, comprising an upper loading surface being defined about its periphery by side edges;

a plurality of blocks secured to the pallet and extending on the underside of and projecting down from the upper loading surface;

located underneath the upper loading surface and spaced inwardly from the side edges thereof, there is at least one oblong shaped reinforcing channel;

walls which are attached underneath the upper loading surface for defining the channel; the channel having an upper side that is at least partly defined by the upper loading surface, the channel being shaped and adapted for removably receiving a reinforcing member;

a reinforcing member in said channel; means for locking the reinforcing member in said channel in a removable way, the locking means comprising one of the walls that defines the channel being recessed on the side facing the upper loading surface and another of the walls that defines the channel being recessed on the side thereof away from the upper loading surface, whereby the reinforcing channel for accommodating the reinforcing member takes an undulatory configuration in its longitudinal direction, so that the reinforcing member is removably clamped in said channel.

4. The pallet of claim 3, wherein the one wall is recessed at first spaced apart locations along the channel while the other wall is recessed at other spaced apart locations along the channel, thereby for defining the undulatory configuration.

5. The pallet of either of claims 5 or 3, wherein the channel has an entrance that is partially closed by an entrance closing wall.

6. The pallet of either of claims 1 or 3, wherein there are at least two intersecting ones of the channels which intersect in one of the blocks.

* * * * *